US007757856B2

(12) United States Patent
Marchal

(10) Patent No.: US 7,757,856 B2
(45) Date of Patent: Jul. 20, 2010

(54) CONSUMABLE PACKAGING FOR CLEAR-BINDERS

(75) Inventor: Jean-Luc Albert Vital Marchal, Singapore (SG)

(73) Assignee: Cosmic Asphalt Technology Pte Ltd, Singapore (SG)

( * ) Notice: Subject to any disclaimer, the term of this patent is extended or adjusted under 35 U.S.C. 154(b) by 748 days.

(21) Appl. No.: 10/558,930

(22) PCT Filed: May 30, 2003

(86) PCT No.: PCT/SG03/00134

§ 371 (c)(1), (2), (4) Date: Feb. 1, 2007

(87) PCT Pub. No.: WO2004/106191

PCT Pub. Date: Dec. 9, 2004

(65) Prior Publication Data

US 2007/0144934 A1 Jun. 28, 2007

(51) Int. Cl.
*B65D 85/00* (2006.01)
*C08L 95/00* (2006.01)

(52) U.S. Cl. ..... 206/524.7; 206/524.6; 524/59

(58) Field of Classification Search ..... 206/524.1, 206/524.6, 524.7; 524/59
See application file for complete search history.

(56) References Cited

U.S. PATENT DOCUMENTS 4,306,657 A 12/1981 Levy
2002/0052431 A1 * 5/2002 Lemoine et al. ..... 524/59

FOREIGN PATENT DOCUMENTS

| | | |
|---|---|---|
| DE | 4428746 | 3/1995 |
| EP | 0017394 | 6/1984 |
| FR | 2608560 | 6/1988 |
| JP | 11321952 A * | 11/1999 |

OTHER PUBLICATIONS

Machine Translation of JP 11-321952 A.*
International Search Report for Cosmic Asphalt Technology Pte Ltd, et al., for International Application No. PCT/SG2003/00134, dated Sep. 23, 2003.
An English Translation of the Abstract of Exhibits 1-3.

* cited by examiner

*Primary Examiner*—J. Gregory Pickett
(74) *Attorney, Agent, or Firm*—Law Offices of Albert Wai-Kit Chan, PLLC

(57) ABSTRACT

A consumable packaging composition is provided for packaging clear-binders, made of one or several packaging materials, alone or in combination, such as plastics, polymers and extenders, and which melting point is adjusted so that the packaging material melts when in contact with the hot aggregates as methods of using them, are also disclosed. Optionally, and prior to packaging, the clear-binder may be mixed together with one or several color pigments used for production of colored mixes depending on the end-user requirements. In a preferred practice, the size of the packaged clear-binder product containers is adjusted such that, after transport and storage, the packaged material together with the packaging material can be directly incorporated along any of the steps of a production process that uses clear-binders. The packaged clear-binder material permits handling and manipulation to be reduced to the minimum necessary, thus avoiding the need for pre-heating and hot-storage of clear-binders.

15 Claims, No Drawings

CONSUMABLE PACKAGING FOR CLEAR-BINDERS

This application is a National Phase application of International Application No. PCT/SG2003/000134, filed May 30, 2003. The contents of the preceding application are incorporated by reference into this application.

TECHNICAL FIELD

The invention relates to a consumable packaging method for clear-binders as well as compositions to prepare it and the resultant packages. The packaging compositions of the invention are composed of at least one packaging material, such as polymers, plastics and extenders and the like, used alone or in combination with a clear-binder material. The components of the packaging material are preferably selected such that they are compatible with a clear-binder product to be packaged. The size of the packaged clear-binder product containers is adjusted such that, after transport and storage, the packaged material together with the packaging material can be directly incorporated along any of the steps of a production process that uses clear-binders. The packaged clear-binder material permits handling and manipulation to be reduced to the minimum necessary, thus avoiding the need for pre-heating and hot-storage of clear-binders.

BACKGROUND ART

This invention relates to the packaging of clear-binders and a composition to prepare it. Clear-binders, also known as synthetic binders or transparent binders or synthetic clear bitumens are well known materials used in road building and industrial applications. They are bitumen-like products and are used likewise for the production of concrete mix, or paving mix, or industrial products, except for the color. While bitumens are black in nature and confer, after mixing with aggregates, a black color to the pavements, clear-binders are more or less transparent and enable for colorless or colored pavements or other applications with the use, or not, of pigments or dyes. Any color can be used for the production of colored mixes. A red color pavement for example, is a common sight.

Clear-binders are used in the same way as bitumens. In the main application, which is for pavement mixes, they are mixed with aggregates using the same installations as those using bitumens, that is bitumen concrete mixing plants or asphalt mixing plants. Additionally however, colored mixes require special care for ensuring consistent color for a given project. In this respect, clear-binders should not be contaminated with normal bitumen, as this would darken the produced mixes by conferring its black color. It is therefore normal practice for bitumen concrete mixing plants to thoroughly flush and clean the whole system, that includes dryer, pugmill, tanks, pipes, pumps, etc, when production of colored mixed follows that of normal black mix.

Flushing of bitumen concrete mixing plant consists in running the plant by mixing hot aggregates with the content of lines and pumps of binder until the final product is clean and free from asphalt or other color contaminating agents. This process may consume up to several tons of material that is ultimately dumped because it does not meet any of the usual material specifications. Bitumen concrete mixing plants that regularly produce colorless or colored pavements may or may not have a separate system to handle clear-binders.

The sensitivity to contamination of clear-binders by normal asphalt is a severe limiting factor to their use and application. Flushing or dedicated facilities incur cost, time and wastage. This all adds to the final cost of colorless or colored pavements.

Compared with normal bitumens, clear-binders are used in relatively small quantities by the paving industry. Due to the specific nature and relatively higher price of clear-binders, containers for transporting them must be dedicated ones and cannot be used for other purposes. As such, clear-binders are most often packed in clean steel drums.

Obviously, the cost for maintaining dedicated containers increases the overall cost of the material and does not prevent from thorough flushing of the installation before use. Drums on the other hand need be heated before transfer of the clear-binder into either a bigger tank or by direct feed into the hot-mix plant. After use, drums must be disposed, as they cannot be re-used for other purpose. It is usually recognized that up to 3% of the clear-binder may remain stuck to the walls of the drum and is consequently wasted. Besides cost consideration, there is a problem of release of waste in the environment.

Ideally, clear-binders should be user friendly and handled in such a way that there is no need for dedicated facility, limited need for flushing, and easy operation enabling to shift from normal asphalt mix production to clear-binder mixes production, in a short time and with as limited as possible production of waste The above discussion is not intended as an admission that any of the foregoing is pertinent prior art. All statements and representations are based on the information available to the applicant and do not constitute any admission as to the correctness of the statements and representations or the public availability of the information.

DISCLOSURE OF THE INVENTION

The present invention provides for the use of clear-binders, packaged by consumable packaging material, which can be directly injected or added together with hot aggregates into the pugmill of bitumen mixing plants or melted into a holding tank prior to injection into the pugmill. The packaging material is made of material that is compatible with the clear-binder and does not significantly modify the properties of the clear-binder itself or that of a product mix containing the clear-binder and packaging material. Ultimately, there should not be any packaging material remaining unmixed in a final clear-binder mix, hence the packaging material is "consumable."

There is a definite need for clear-binder product packaging that is strong enough for ease of handling, transport and storage. Such packaging should be economical enough to compete against other types of packaging and should preferably incur little or no release of wastage into the environment. It should ideally be compatible with the material contained within it. The packaging material may have a higher density than that of the contained clear-binder material to facilitate subsequent heating and melting processes.

The present invention provides a composition that may be used as a packaging material for clear-binder products. The composition is composed of plastic or polymer material optionally combined with a clear-binder material. The plastic or polymer material is preferably compatible with the clear-binder product to be packaged and has a melting point that is adjusted so that the material melts when in contact with the hot aggregates used to produce colorless or colored mixes with a clear-binder. Optionally, and prior to packaging, the clear-binder may be mixed together with one or several color pigments used for production of colored mixes depending on the end-user requirements. The invention also provides packages comprising a clear-binder product and a packaging material as described herein. Alternatively, the packaging material may be formed into containers to contain a clear-binder product.

In a preferred practice, the packaging material contains part of the clear-binder itself or derivatives, for the purpose of pre-compatibilization, cost consideration, and to facilitate the dispersion of the packaging into the aggregate mix. During the mixing process, the mass of the hot aggregates raises the temperature of the packaging material and to the clear-binder contained therein. As both packaging material and contained clear-binder melt, the melting and mixing processes proceed simultaneously. The invention permits the avoidance of waste packaging materials that must be disposed of because the materials are incorporated with the clear-binder into the mix. Upon completion of the mixing process, the product mix is used in standard ways.

Therefore, and in a first aspect, the invention provides a composition for forming consumable packaging for clear-binder products, said composition comprising a moldable material composed of a plastic or polymer material with a melting point from 50 to 150° C. Preferably, the packaging contains a clear-binder product.

In the description and claims that follow, the term clear-binder or clear-binder product is employed to mean natural or synthetic or transparent or clear-binder or resin-derived products used for the production of colorless or colored mixes for use as road pavements. A clear-binder product is a material composed of mostly organic, and/or carbonaceous, substances. A clear-binder product as used herein refers to naturally occurring or heat refined or synthetic substances derived from petroleum or from other organic sources like wood, coal and the like. Clear-binders can be made from a single component or from the blend of several components that include resins, oils, extenders, polymers, extracts, and derivatives. Clear-binders are more or less transparent and may be used for colorless or colored pavements. The invention may also be practiced with blends of different kinds of clear-binder products. A clear-binder product material can be used in pure form or in a chemically modified form. Clear-binders may be of a variety of grades, including, but not limited to, road paving, coating, waterproofing, and sealing grades. The invention is directed to clear-binders of any industrial grade or for any industrial application.

The compositions for the packaging of a clear-binder product according to the present invention may be formed into containers of any shape and form having a capacity of about 0.1 liter to about 50 liters, preferably about 2 liters to about 5 liters and even more preferably about 3 liters. They preferably have a melting point between 50 to 150 degrees C. and are composes of material comprising a plastic or polymer material. Examples include, but are not limited to, polymers, plastic compounds and additives, or blend thereof, such as polyethylene and derivatives, polypropylene and derivatives, polystyrene, ethylene vinyl acetate copolymer, ethylene methyl acrylate copolymer, styrene butadiene, styrene butadiene styrene copolymer, styrene indene styrene copolymer, styrene butadiene rubber, natural rubber, polyacrylate, polyolefins, atactic polypropylene, and combinations thereof. They optionally comprise isobutanol and isopropanol with the plastic or polymer material used. The packaging material may contain some clear-binder product for the purposes of pre-compatibilization or "pre-blending", cost reduction and ease of dispersion of the packaging material into the aggregate mix.

In accordance with the invention, the composition of the packaging material is first designed to fit with the contained clear-binders and its final use. The melting point of the material may adjusted by means of proportioning (adjusting the amount of) high and low melting point plastic or polymer materials as components in the packaging material. The adjustment of the melting point of the packaging takes into consideration the various constraints imposed by the mixing operations such as, but not limited to, the temperature limit before degradation of the clear-binder and pigments, allowable mixing time to ensure suitable dispersion of the packaging material into the aggregate mix, and melting temperature of the clear-binder during the packaging process. Another consideration is the temperature of the clear-binder during filling operations into containers of the present invention such that the containers will not melt or overly deform during said operations.

The composition optionally further comprises an extender which maintains the relative amounts of the plastic or polymer material and optional blended clear-binder product. Non-limiting examples of such extenders include antioxidants, UV stabilizers, surfactants, binders, colourants, and mixtures thereof.

The components of a packaging material composition are proportioned and blended together at the suitable temperature to allow for efficient mixing of all components. Upon mixing and homogenization, the composition is then processed through package forming devices, such as blowing or film blowing machine, injection molding machine, casting devices, forming machines, with the objective to produce containers of any form and shape of a given capacity between about 0.1 to about 50 liters, preferably about 2 liters to about 5 liters and even more preferably about 3 liters. The containers may be used in transport and/or melt-processing operations, particularly of clear-binder products. Such containers may be in any suitable shape or size, including, but not limited to a sealable bag, barrel, box, bowl, or cylinder. The size and shape of the containers may take into account logistical constraints and economical considerations. The clear-binder is subsequently packaged in the produced containers using any suitable filling device. The containers may be further packed into any suitable sizeable container such as paper bags, plastic bags, bulky bags, drums, carton boxes, ISO containers, etc. The compositions of the invention may also be used to make films of various thicknesses and suitable for packaging.

Compared with previously used packaging material and processes for packaging of clear-binder products, the disclosed invention provides the advantages including the following. In the case of packaged clear-binder products, it eliminates the need for dedicated storage, pumps, lines, etc for clear-binders and therefore incurs significant cost savings for the end-user. The packaged clear-binders can be incorporated along any of the steps of the production processes making use of clear-binders, such as mixing plants, pugmill. The packaged clear-binder can be added directly into the pugmill together with the mineral aggregates for the production of concrete mix, or paving mix. Additionally and when directly injected into the pug-mill of the asphalt concrete mixing plant, it eliminates the need to heat-up the clear-binder before use. Similarly, the invention eliminates the need for flushing tanks, lines, pumps, etc and therefore enables quick and economical switch from normal black asphalt to clear-binders production uses. The invention also permits savings of up to 5% compared with traditional packaging methods (where clear-binder material is lost with disposal of the packaging material) because the packaging material becomes incorporated into the clear-binder itself. This also reduces the need to dispose of used packaging materials, with any residual amounts of clear-binder products, into the environment.

Generally, only the suitable quantity of clear-binder is used without having to heat-up larger quantities contained in drums or tanks. The invention also reduces or eliminates the oxidation and aging effects due to over or prolonged heating of clear-binders before mixing with aggregates. The invention also permits the packaging to contain part or all of the pigments used for colored pavement mixes. This feature reduces the need to make separate feeding of the pigments into a mixing device to save time and provide for more consistent color throughout the mixing process.

The invention further provides for clear-binder materials to be "pre-blended" in preparing the compositions of the invention such that the resultant packaging materials are "pre-compatibilized" for dispersion into a clear-binder product during a melting process. The "pre-blended" or "pre-compatibilized" material also allows for the design of thicker walled containers and films, as well as reinforcement structures within said containers, with virtually no risk of finding thicker, non-dissolved or non-molten pieces of packaging material during a heating and melting process. Thicker and stronger packaging materials permits safer handling and longer storage time as well as reduced risk of punctures and subsequent leakage.

In a further aspect of the invention, methods are provided for the production of compositions as disclosed herein. The invention also provides for the use of packaged clear-binders, or clear-binder containing containers, as a substitute or addition to a melted clear-binder in a process which utilizes a clear-binder. Therefore, the packages and containers of clear-binders disclosed herein may be used in any method of preparing clear-binders for use in road paving, coating, waterproofing, sealing, and other applications to reduce or replace the amount of melted clear-binder otherwise used in the method. Non-limiting examples include directed injection into a mixer or the pugmill of an asphalt or concrete mixing plant. Stated differently, the invention provides a method of preparing a mixture comprising a clear-binder, wherein said method comprises introducing a package, or container, of clear-binder as disclosed herein into a mixture of other components. Non-limiting examples of such other components include sand, rocks, gravel and road paving aggregates.

MODES OF CARRYING OUT THE INVENTION

Generally, the plastic or polymer material used in the practice of the invention is any that is compatible with the material to be packaged and that is suitable for use as packaging material formed from the compositions of the invention. The compositions of the invention have the necessary physical properties such that packaging materials formed therefrom have the required toughness, impact resistance, temperature stability, and/or flexibility.

Exemplary plastic or polymer materials for use in the practice of the invention include, but are not limited to, ethylene, propylene, ethylene-propylene copolymers, and butylene copolymers. Alternatively, copolymers of acrylates and methacrylates, such as butyl, propyl, ethyl, or methyl acrylate or methacrylate copolymerized with ethylene, propylene, or butylene, may also be used. Epoxy-functionalized copolymers such as a terpolymer of ethylene, butyl acrylate and glycidyl methacrylate may also be used to improve the impact-resistance and flexibility of packaging materials made thereof. Natural or synthetic rubbers may also be used; non-limiting examples include styrene-butadiene-styrene (SBS), styrene-butadiene rubber (SBR), styrene-ethylene-butylene-styrene (SEBS), or terpolymer made from ethylene-propylene diene monomer (EPDM). In one embodiment, the material includes an ethylene-vinyl acetate copolymer with a vinyl acetate content from about 9% to about 40% by weight, so that it is soluble in asphalt or other clear-binder products. Mixtures of the above materials may also be used.

Particularly preferred plastic or polymer materials for use in the invention are selected from polyethylene and derivatives, polypropylene and derivatives, polystyrene, ethylene vinyl acetate copolymer, ethylene methyl acrylate copolymer, styrene butadiene, styrene butadiene styrene copolymer, styrene indene styrene copolymer, styrene butadiene rubber, natural rubber, polyacrylate, polyolefins, atactic polypropylene, mineral or natural or synthetic fibers such as cellulose fibers, recycled plastics from waste, and combinations thereof. These are optionally used with isobutanol or isopropanol. Ethylene-vinyl-acetate is especially preferred in the practice of the invention. In some embodiments of the invention, the material is a random copolymer of ethylene and unsaturated monocarboxylic acid that is neutralized with a metal ion.

The clear-binder material optionally present in the compositions may be a clear-binder product as described herein. It may be advantageous to maximize the amount of clear-binder material in the compositions of the invention where they are of a lower cost than the plastic or polymer materials.

The compositions of the invention may be formed into a variety of packaging materials, including containers of various shapes and sizes. Examples of possible containers include those described in U.S. Pat. Nos. 5,733,616; 5,989,662, and 6,107,373. Other possible containers are those described in published applications WO 98/39221, WO 99/30973, and WO 00/55280.

The compositions may also be formed into sealable bags or films like that described in U.S. Pat. No. 5,452,800 for use in packaging. The thickness of such bags or films may be readily determined by the skilled person depending on the application to which the bags or films are to be used.

The compositions, when used as a packaging material, preferably have a melting point high enough to tolerate the temperatures of a molten clear-binder product, such as that during a filling operation to prepare packages and containers of clear-binders as disclosed herein.

A container of the invention may be formed by any convenient process. Without limiting the invention, the sidewalls of the container can be bonded to the base. In preferred embodiments, the container is formed as an integral or unitary structure by injection molding, blow molding, rotation molding, or other molding processes. As known to the skilled person, a molding process usually involves the use of a heat-softened composition to be molded. The heat-softened composition is injected, blown, or otherwise formed via a mold into a desired shape and size. After cooling and solidification, the composition takes the shape of the mold cavity.

The containers of the invention can also be adapted to have handholds, breakaway sections, recesses, and ribs to increase its strength. The ribs may be internal or external to the container and may also serve to provide stability of shape to the container. The container should have sufficient strength to support molten clear-binder product without tearing or significant yielding.

As noted herein, the packaging materials of the invention are consumable such that they would be incorporated into the packaged clear-binder product upon its heating or melting. Optionally, the packaging materials of the invention have a higher specific gravity than the packaged clear-binder product such that the materials do not "float" to the surface of the product upon heating. The materials are not "buoyant" in a melted or molten clear-binder product. This facilitates the dissolution and dispersion of the packaging materials into the heated clear-binder product.

The packaging materials are preferably used to contain clear-binder products as described herein. The compositions and packaging materials of the invention may be "pre-blended" with clear-binder material to improve their dissolution in clear-binder products upon heating or melting. "Pre-blending" refers to the incorporation of clear-binder material into the compositions and packaging materials before the latter are to be dispersed into the packaged clear-binder products.

The compositions of the invention are readily prepared by formulating a plastic or polymer material as described herein and/or by standard methods in the field. The combination is preferably heated, and mixed or blended, to form a homogenous composition. This blended material may be used directly to form packaging materials of the invention or cooled for later use to prepare packaging materials.

The compositions and packaging materials of the invention preferably do not significantly alter the characteristics of a clear-binder product packaged therewith after the compositions and packaging materials are dispersed into the product. As non-limiting examples, clear-binder products containing the dispersed composition or packaging material differ from the same clear-binder product without the dispersed material by not more than about 5 to about 15% in penetration (by 0.1 mm increments) at 25° C. as determined by ASTM D5; by not more than about 5 to about 30% in softening point temperature as determined by ASTM D36; by not more than about 10% in viscosity (by cSt) as determined by ASTM D445; by not more than about 1 to about 10% in ductility (by cm) as determined by ASTM D13; and by not more than 1% in trichloroethylene solubility (by %) as determined by ASTM D2042.

In accordance with a particularly preferred embodiment of the invention, the composition of the packaging material is first designed to be compatible with the contained clear-binder product and in a form suitable for its final intended use. The components of the packaging material are proportioned and blended together at the suitable temperature to allow for efficient mixing of all components. After mixing and homogenization, the packaging mixture is then processed through package forming devices, such as a blowing or film blowing machine, an injection molding machine, a casting device or a forming machine to produce containers of the desired form and shape. The size and shape of the containers may take into account logistics constraints and economical considerations. The molten clear-binder product is subsequently packaged in the produced containers using any suitable filling device and allowed to cool therein.

DEFINITIONS OF TERMS USED HEREIN

As used herein, the terms "comprise", "comprises", "comprised" or "comprising" are to be interpreted as specifying the presence of the stated features, integers, steps or components referred to, but not to preclude the presence or addition of one or more other feature, integer, step, component or group thereof. Stated differently, and as used herein, the term "comprising" and its cognates are used in their inclusive sense; that is, equivalent to the term "including" and its corresponding cognates.

As understood generally, "density" is used herein to refer to the measure of the mass of a unit volume of a substance. It is thus "volumetric density" as opposed to "linear density" or "area density".

"Specific gravity" as used herein refers to "relative density" or a measure of how the density of one substance compares with another. The "other" substance is most often pure water, with a density of 1 kg per liter. "Specific gravity" has no units because it is a ratio of two densities.

Unless defined otherwise all technical and scientific terms used herein have the same meaning as commonly understood to one of ordinary skill in the art to which this invention belongs.

The following examples are put forth so as to provide those of ordinary skill in the art with a complete disclosure and description of how to make and use the present invention, and are not intended to limit the scope of what is regarded as the invention nor are they intended to represent that the experiments below are all and only experiments performed. Efforts have been made to ensure accuracy with respect to numbers used (e.g. amounts, temperature, etc.) but some experimental errors and deviations should be accounted for. Unless indicated otherwise, parts are parts by weight, molecular weight is weight average molecular weight, temperature is in degrees Celsius, and pressure is at or near atmospheric.

Example 1

Preparation of Packaging Material for a Clear-Binder Product

A packaging material for clear-binder product was prepared as follows. Proportion of components of the packaging material is in percent by weight.

The packaging material was composed of 85% of ethylene-vinyl-acetate copolymer, having a melt-flow index of 9 (g/10 min) and a melting point of 96° C., and 15% of a standard clear-binder of penetration 50/70 1/10-mm at 25° C. The resulting melting point of the preparation was measured at 87° C. by Differential Scanning Calorimetry (DSC). After thorough blending at 170° C. of the components for approximately 1 hour, the packaging material was formed into sheets of approximately 0.8 mm thick. Non-specific shape containers of approximately 0.3-liter capacity were formed from the sheets. A standard clear-binder of penetration at 25° C. of 50/70 1/10-mm, was poured into the containers at a temperature of approximately 70° C. The containers were left to cool to ambient temperature. Upon cooling down, the lips of the container were sealed using a hot air welding machine so that the clear-binder was tightly sealed inside of the containers.

The clear-binder in the 300 grams containers was then used to produce a laboratory scale colorless mix at 5% by weight of clear-binder using a laboratory mixer. 30 kilograms of aggregates which grading was from 0 to 10 mm following standard dense mix design, were heated in an oven to a temperature of 170° C. Upon drying and heating at temperature, the aggregates were transferred into a laboratory mixer of 50 liters capacity. The paddle mixer was started and 5 of the containers above, for a total weight of 1,580 grams, were added to the aggregate mixture at a temperature of about 160 degrees C. Upon 5 minutes mixing time, the mix was looking satisfactory and the mixer was stopped.

At the initial stage of the mixing, the containers slowly started to deform and partially melt. It took approximately 2 minutes for the packaging material to actually melt and to free the contained clear-binder. Over the following 90 seconds, the mixing process actually took place and the clear-binder was dispersed throughout the mix. The mixer was left running for another 30 seconds to ensure full dispersion of both packaging and clear-binder. After mixing, the mix showed no remaining particles or pieces of non-molten packaging film and had the same appearance than the same mix prepared from pure and hot clear-binder. In this experiment, the difference in mixing time between pure hot clear-binder (melted before addition to the mixer) and cold packaged clear-binder is about 3 minutes, i.e. an increase by 300%. On industrial scale, and given the more powerful mixers used for mix production, the increase in mixing time can be estimated to about 50 to 100%. This increase can be considered as reasonable with regard to all other benefits associated with the packaging.

Another experiment was carried out in order to identify the effect of the addition of packaging material to the clear-binder. A neat standard clear-binder of penetration 50/70 1/10-mm at 25° C. was added, at about 135° C., with 2.5% by weight of the packaging material as described above. The mixture was gently stirred for about 2 minutes until all packaging material was dissolved into the binder. Upon mixing, a sample from the treated clear-binder was taken and was tested against a neat sample of the same clear-binder having undergone the same heat treatment. The test results are given in Table 1.

TABLE 1

Test results on clear-binder specimens

| Test | Method | Unit | Typical | Neat Clear Binder | Treated Clear Binder |
|---|---|---|---|---|---|
| Penetration at 25° C. | ASTM D5 | 0.1 mm | 50 to 70 | 69 | 65 |
| Softening point | ASTM D36 | ° C. | 50 to 60 | 56 | 58 |
| Viscosity at 135° C. | ASTM D445 | cSt | >300 | 313 | 358 |
| Ductility at 25° C. | ASTM D13 | cm | >100 | >100 | >100 |
| Flash point, COC | ASTM D92 | ° C. | >232 | 304 | 302 |
| Solubility in trichoroethylene | ASTM D2042 | % | >99 | 99.80 | 99.73 |
| Thin Film Oven Test | ASTM D1754 | | | | |
| Mass loss | | % | <1 | 0.38 | 0.26 |
| Retained penetration | | % | >70 | 71.9 | 76.8 |

The results in Table 1 indicate that there is no significant effect of the packaging material on the packaged clear-binder, which keeps its characteristics within the usual specified range.

All references cited herein, including patents, patent applications, and publications, are hereby incorporated by reference in their entireties, whether previously specifically incorporated or not.

Having now fully described this invention, it will be appreciated by those skilled in the art that the same can be performed within a wide range of equivalent parameters, concentrations, and conditions without departing from the spirit and scope of the invention and without undue experimentation. The invention also includes all of the steps, features, compositions and compounds referred to or indicated in this specification (unless specifically excluded) individually, collectively, and any and all combinations of any two or more of said steps or features.

While this invention has been described in connection with specific embodiments thereof, it will be understood that it is capable of further modifications. This application is intended to cover any variations, uses, or adaptations of the invention following, in general, the principles of the invention and including such departures from the present disclosure as come within known or customary practice within the art to which the invention pertains and as may be applied to the essential features hereinbefore set forth.

The invention claimed is:

1. A consumable package comprising a clear-binder product and a packaging material, the packaging material comprising: a plastic or polymer material with a melting point from 50 to 150° C.; and a clear-binder material, wherein the plastic or polymer material is compatible with the clear-binder material thereby facilitating the dispersion of the packaging material into the package during a melting process.

2. A package according to claim 1, wherein the capacity of the package is from about 0.1 liter to about 50 liters.

3. A package according to claim 1, wherein the packaging material comprising the plastic or polymer material is, selected from the group consisting of polyethylene and derivatives, polypropylene and derivatives, polystyrene, ethylene vinyl acetate copolymer, ethylene methyl acrylate copolymer, styrene butadiene, styrene butadiene styrene copolymer, styrene indene styrene copolymer, styrene butadiene rubber, natural rubber, polyacrylate, polyolefins, atactic polypropylene, mineral or natural or synthetic fibers such as cellulose fibers, recycled plastics from waste, and mixtures of two or more of such items; and optionally isobutanol or isopropanol.

4. A package according to claim 1 wherein the clear binder product is of road paving grade.

5. A package according claim 1, wherein the clear-binder product is colorless or essentially colorless.

6. A package according to claim 5, wherein the packaging material further comprises one or more pigments or dyes used in the colored pavement industry.

7. A consumable container containing a clear-binder product wherein the container is composed of: a plastic or polymer material with a melting point from 50 to 150° C.; and a clear-binder material, wherein the plastic or polymer material is compatible with the clear-binder material thereby facilitating the dispersion of the packaging material into the container during a melting process.

8. The container according to claim 7, wherein the capacity of the container is from about 0.1 liter to about 50 liters.

9. The container according to claim 7, wherein the packaging material comprising the plastic or polymer material is, selected from the group consisting of polyethylene and derivatives, polypropylene and derivatives, polystyrene, ethylene vinyl acetate copolymer, ethylene methyl acrylate copolymer, styrene butadiene, styrene butadiene styrene copolymer, styrene indene styrene copolymer, styrene butadiene rubber, natural rubber, polyacrylate, polyolefins, atactic polypropylene, mineral or natural or synthetic fibers such as cellulose fibers, recycled plastics from waste, and mixtures of two or more of such items; and optionally isobutanol or isopropanol.

10. The container according to claim 7 wherein the clear binder product is of road paving grade.

11. The container according to claim 7, wherein the clear-binder product is colorless or essentially colorless.

12. The container according to claim 7, wherein the container further comprises one or more pigments or dyes used in the colored pavement industry.

13. The container of claim 7 which is formed by blow-molding, casting, injection molding or, the use of a forming apparatus.

14. The container of claim 13 which is in the form of a sealable bag, barrel, box, bowl, or cylinder.

15. The package of claim 1 wherein the packaging material is in the form of a consumable film composed of the packaging material.

* * * * *